US005452556A

United States Patent [19]

Taylor

[11] Patent Number: 5,452,556

[45] Date of Patent: Sep. 26, 1995

[54] METAL-WOOD STUD

[75] Inventor: Jimmie R. Taylor, 11738 Hidden Hills Dr., Jacksonville, Fla. 32225

[73] Assignees: Lockwood Homes; Taylor; Jimmy R., both of Jacksonville, Fla.

[21] Appl. No.: 202,825

[22] Filed: Feb. 28, 1994

[51] Int. Cl.[6] ..... E04C 3/292; E04C 3/36

[52] U.S. Cl. ..... 52/730.7; 52/731.1; 52/731.8; 52/731.9; 52/481.1

[58] Field of Search ..... 52/731.1, 731.7, 52/731.8, 731.9, 376, 481.1, 712

[56] References Cited

U.S. PATENT DOCUMENTS 3,960,637 6/1976 Ostrow ..... 52/730.7 X
4,720,957 1/1988 Madray ..... 52/731.7
5,024,039 6/1981 Karhumäki ..... 52/731.1 X
5,210,990 5/1993 Kirk, Jr. ..... 52/664

FOREIGN PATENT DOCUMENTS 2052596 1/1981 United Kingdom ..... 52/730.7

*Primary Examiner*—Carl D. Friedman
*Assistant Examiner*—W. Glenn Edwards
*Attorney, Agent, or Firm*—Arthur G. Yeager

[57] ABSTRACT

A fabricated combination of an elongated metal channel and at least two short lengths or end portions of a wooden rectangular beam forms a standard length stud having a metal central portion and exposed wooden end portions. Another short wood portion may be disposed medially of the short end portions to further rigidify the stud.

19 Claims, 1 Drawing Sheet

METAL-WOOD STUD

BACKGROUND OF THE INVENTION

This invention relates to substitutes for wooden beams employed in the construction industry, principally in the building of homes, offices, and other places where people live and work.

Walls in buildings are usually made by erecting a framework of a plurality of spaced vertical wooden beams called "studs" joined together into a unit by an upper horizontal wooden beam and a lower horizontal wooden beam (called "plates"). Sheets of wall board are then applied to both sides of the framework to produce finished wall surfaces that may be painted, papered, or the like as desired. It has been recognized that metal beams rather than wooden beams are suitable, and often preferred, e.g., to eliminate the possibility of termite damage. In more recent times, as the cost of wooden beams has increased and the availability of wooden beams has decreased, it has become clear that there is a need for an improved and less costly beam.

Some beams, e.g., those supporting a wall, need not be load-bearing beams, and it is principally these beams to which this invention applies. It is an object of this invention to provide a novel metal-wood beam useful as a wall stud. It is another object of this invention to provide a novel use for short lengths of wooden beams, i.e., those lengths that are frequently discarded as waste. Still other objects will appear from the more detailed description which follows.

BRIEF SUMMARY OF THE INVENTION

This invention relates to an elongated combination metal-and-wood beam, principally useful as a wall stud in the home construction industry. The combination includes a central elongated metal channel and two short lengths of a wooden beam, e.g., 2×4 pine, to function as the end portions of the beam, rigidly attached to the metal channel. The channel has inturned flanges that are pressed into the short wooden beams and in the channel walls are spaced punched tabs that are directed inwardly into and remain embedded in the beams. The central metal channel preferably includes a cutout portion through which electric wires or plumbing conduits can be extended for connection to appliances.

In preferred embodiments there are two wooden lengths for each combination beam; although in some instances there may be three or four such lengths in each beam. Generally, beams of standard sizes are provided, although special lengths are easily prepared. Beams such as 2×3, 2×4, 2×6, 2×8 in 8–12 foot lengths are provided by this invention. Usually the metal channel is steel, but other metals may be employed as desired.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The features and advantages of this invention are best understood and appreciated by consideration of the attached drawings in connection with the following description.

Figure 1:
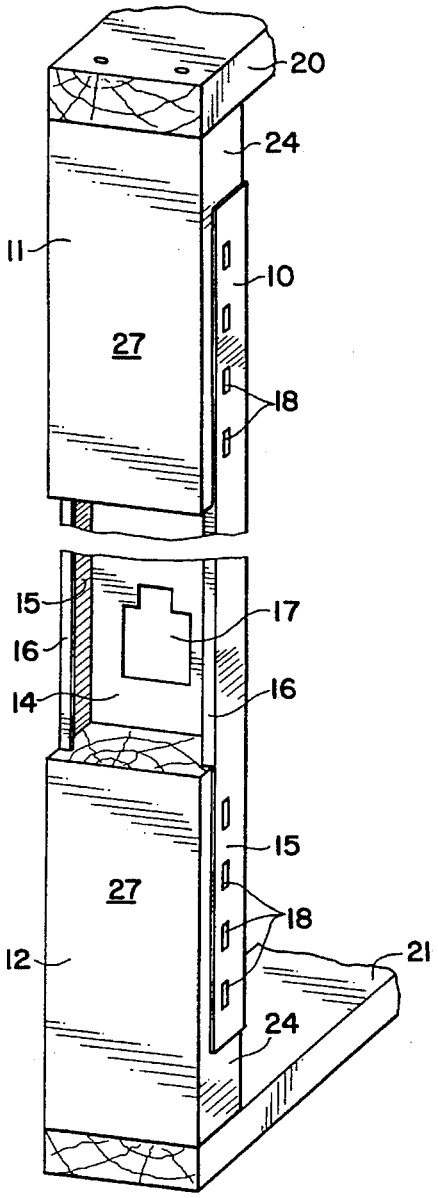
FIG. 1 is a perspective view of the combination beam of this invention as a part of a wall structure.

FIG. 1 shows a principal use for the combination beam of this invention; namely, as a stud in a wall structure having an upper plate 20 and a floor or toe plate 21 with a plurality of vertical studs spaced apart at intervals of about sixteen inches. Each stud preferably is the combination beam shown in detail in FIGS. 2–5.

Each combination beam includes a central, elongated metal channel 10, 6–11 feet in length terminated at each end, respectively, by short lengths or end portions 11 and 12 (10–24 inches) of wooden beams. Each end section 11 and 12 fits closely within the recess 23 of channel 10. Channel 10 has a bottom wall 14 and two parallel side walls 15 substantially perpendicular to bottom wall 14. To provide the necessary rigidity for the beam, channel 10 is firmly affixed to wooden beams 11 and 12 in at least two ways; firstly, by the pressing of flanges 16 at the upper end of side walls 15 into the sides 24 and 25 of wooden end portions 11 and 12; and secondly by punching tabs 18 into wooden beams 11 and 12 which remain embedded in the wood.

Side walls 15 of metal channels 10 are formed with a narrow, inturned flange at the upper end of each side wall 15. The short length of wooden beam 11 and/or 12 is then placed in the recess channel 10 between walls 15 after flexing same outwardly with the rear wall 26 resting on channel bottom wall 14. Pressure is then applied, as from a vise or a press to cause each side wall 15 to be pressed against opposite sides 24, 25, respectively, of the wooden beams 11, 12, causing flanges 16 to be pressed into the wood and to become embedded therein with the wooden beam front face 27 being exposed outwardly of the channel 10.

Spaced apart on side walls 15, and if desired, on bottom wall 14 are preferably rectangular punchouts or tabs with three adjacent sides being cut and a fourth side remaining as part of the side walls 15 of channel 10. Upon the application of sufficient cutting die force perpendicular to the sides 15 the tabs will be punched inwardly from the surrounding metal of the channel and the fourth side will fold. This produces a rectangular tab 18 embedded in each of the wooden beams 11 and 12 functioning much like a nail. These tabs 18 may be located on the side walls 15 or as tabs 19 on bottom wall 14, or both. Tabs 18 may be punched inwardly by use of a hammer and a punch, but preferably are punched inwardly by a press operation simultaneously with the pressing of lips 16 into the wooden beams as clearly set forth above. For a 2×3, 2×4, 2×6, or 2×8 beam, tabs 18 are preferably about ¼ inch×½ inch in size with one of the smaller sides remaining with the metal side walls 15 and when punched, tabs 18 are embedded about ½ inch into the wood. Although the preferred shape of tabs 18 and tabs 19 is rectangular, they may alternatively be triangular, semieliptical, trapezoidal, or other simple shapes without departing from this invention.

Figure 2:
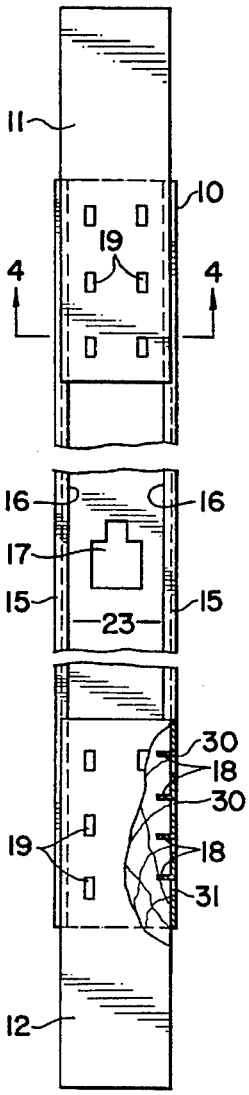
FIG. 2 is a front elevational view of the beam of this invention.
Figure 3:
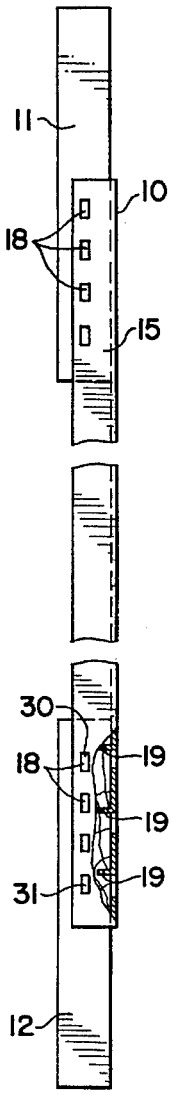
FIG. 3 is a side elevational view of the beam of this invention.
Figure 4:
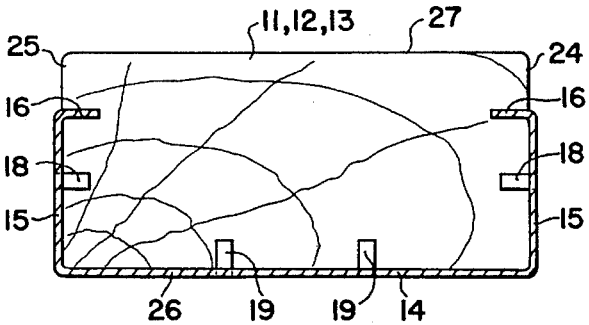
FIG. 4 is a cross-sectional view taken at 4—4 of FIG. 2.

It has been found to be preferable that when, for example, four tabs 18 are punched in each side wall, two of the tabs 18 should remain connected to the metal side wall at spaced longitudinal locations than the other two tabs 18, i.e., see the connection lines 30 and 31 in FIGS. 2 and 3. This arrangement provides a secure hold against compressive and tensile forces exerted on the wooden beam portions 11 and 12 and permits handling, transporting and use of the combination metal and wood beam as a common wood stud, primarily in non-load bearing walls.

The central portion of channel 10 includes an indefinite length which is not filled with a wooden beam and which includes a conventional cutout area 17 through which electric wires, water pipes and other conduits may be disposed so as to hide these from view. Cutout area 17 may be of any desired shape, and should be approximately the same distance from the ends of other metal studs so as to leave room for a substantially horizontal run of wiring or conduit through the wall.

Figure 5:
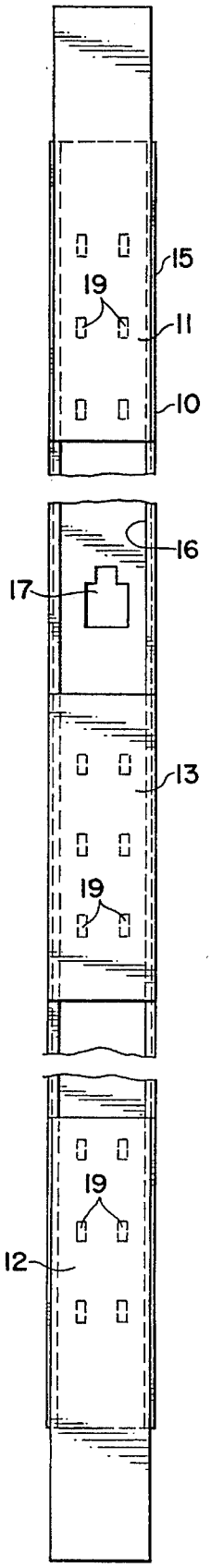
FIG. 5 is a front elevational view of another embodiment of this invention.

FIG. 5 shows another embodiment differing from that of FIGS. 1–4 in that it employs three short lengths or portions of wooden beams, 11, 12, and 13. The inclusion of the third portion of wooden beam 13 is generally not of any special importance other than to provide a central length of wooden beam into which nails or screws can be put in order to assist in hanging wall board or other special wall coverings or fittings for appliances. The inclusion of a third beam member 13 may also increase the stiffness of the combination beam in which it is included.

One of the advantages of the present invention is to provide a use for scrap lumber which accumulates at every building site as carpenters trim lumber to fit a particular use at the building, or at lumber yards where trusses and the like are fabricated.

Of course, for economical reasons, primarily, the gauge of the metal channel should be as light as reasonably permitted, for example, 24–26 gauge, particularly for a non-load bearing stud. In the event a load bearing stud is found desirable, it is possible to employ the FIG. 5 construction perhaps with another metal channel without flanges 16, and the bottom of the channel would be against front wall 27 of the beam 11 and the side walls would contain the punched out tabs like 18 but going through both thicknesses of metal side walls.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed and what it is desired to secure by Letters Patent of the United States is:

1. An elongated pre-fabricated construction beam of rectangular cross-section comprising an elongated substantially U-shaped steel channel beam having opposite end portions and a bottom wall and a pair of spaced outer side walls extending upwardly therefrom, a pair of short rectangular spaced wooden end beams each having upper and lower walls and opposed vertical walls, said wooden end beams being located in said channel beam to dispose said lower wall contiguous with said bottom wall and to dispose said vertical walls contiguous with respective said side walls, said wooden end beams substantially filling said U-shaped steel channel beam adjacent its opposite end portions and extending longitudinally outward therefrom, and means for rigidly connecting each said wooden end beam to said channel beam.

2. The beam of claim 1 wherein said means for connecting includes a plurality of spaced tabs struck from said side walls inwardly to become embedded in said wooden end beams.

3. The beam of claim 2 wherein said tabs on each said side wall are struck in different directions toward respective said wooden end beams to rigidly affix said wooden end beams to said channel beam to inhibit compressive and tensile movement therebetween during handling thereof.

4. The beam of claim 2 wherein each said tab extends substantially perpendicular to respective said side walls.

5. The beam of claim 1 further including another short wooden beam located spacedly between said pair of spaced short wooden beams and being connected to said channel by said means for connecting.

6. The beam of claim 5 wherein said means for connecting includes a plurality of spaced tabs struck from said side walls of said channel inwardly to become embedded in said wooden end beams and said another short wooden beam.

7. The beam of claim 6 wherein each said tab extends substantially perpendicular to respective said side walls.

8. The beam of claim 7 further including another plurality of spaced tabs located along said channel bottom wall and embedded in respective said wooden beam.

9. A combination elongated metal-and-wood beam comprising an elongated substantially U-shaped metal channel having opposite ends and having a bottom wall and a pair of spaced outer side walls extending upwardly therefrom and having an inwardly facing flange at each upper edge of each said outer side wall, a pair of spaced short wooden beams of rectangular cross-section located at each of said ends of said channel, said channel ends overlapping a portion of each said wooden beam in a longitudinal direction with said wooden beams extending longitudinally outwardly therefrom and fitting closely around three sides of each said wooden beam, each of said beams having a rear wall and a pair of side walls extending from said rear wall, each said flange being pressed and penetrating into respective said walls of each said beam, each said channel side wall having a plurality of lengthwise spaced tabs extending generally perpendicular to said channel side wall and penetrating into each of said side walls of each of said beams.

10. The combination beam of claim 9 further including a cutout portion in said channel bottom wall in a generally central location free of any contiguous wooden beam.

11. The combination beam of claim 9 further including another wooden beam located spacedly between said pair of spaced short wooden beams and being substantially connected to and in said channel by said flanges and additional tabs.

12. The combination beam of claim 9 further including another plurality of spaced tabs located along said channel bottom wall and embedded in respective said wooden beam.

13. A combination steel-and-wood wall stud comprising an elongated steel rectangular channel and at least two short lengths of rectangular wooden beams fitting closely within and affixed rigidly to said channel and extending longitudinally beyond respective ends of said channel, said channel having in cross-section a bottom wall, a par of spaced outer side walls extending perpendicular to said bottom wall and an inwardly turned flange at respective upper edges of side walls, said flanges being pressed into and embedded in a respective said wooden beam along its sides, said side walls having spaced tabs struck from and integral therewith and embedded inwardly into said sides of said wooden beam in contact with said side walls of said channel.

14. The beam of claim 1 wherein said upper wall of each said end beams extends outwardly from the upper edges of said side walls of said channel beam.

15. The beam of claim 14 wherein said upper edges of said side walls include inturned flanges which are embedded into respective vertical walls of each said end beam.

16. The beam of claim 9 wherein each said tab extends substantially perpendicular to respective said side walls.

17. The beam of claim 9 wherein said tabs on each said side wall are struck in different directions toward respective said wooden end beams to rigidly affix said wooden end beams to said channel beam to inhibit compressive and tensile movement therebetween during handling thereof.

18. The beam of claim 13 wherein each said tab extends substantially perpendicular to respective said side walls.

19. The beam of claim 13 wherein said tabs on each said side wall are struck in different directions toward respective said wooden end beams to rigidly affix said wooden end beams to said channel beam to inhibit compressive and tensile movement therebetween during handling thereof.

* * * * *